US006235699B1

(12) United States Patent
Del Duca et al.

(10) Patent No.: US 6,235,699 B1
(45) Date of Patent: May 22, 2001

(54) LIQUID AQUEOUS CLEANING COMPOSITIONS

(75) Inventors: Valerio Del Duca, Massalubrense; Dennis Gerard O'Sullivan, Rome; Carlo Ricci, Rome; Roberto Scaramella, Rome; Stefano Giunti, Fermignano; Sabina Antonioli, Rome, all of (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/355,712

(22) PCT Filed: Jan. 28, 1998

(86) PCT No.: PCT/US98/01560

§ 371 Date: Aug. 3, 1999

§ 102(e) Date: Aug. 3, 1999

(87) PCT Pub. No.: WO98/33879

PCT Pub. Date: Aug. 6, 1998

(30) Foreign Application Priority Data

Feb. 3, 1997 (EP) ..... 97870013
Oct. 8, 1997 (EP) ..... 97870153

(51) Int. Cl.[7] ..... C11D 3/395; C11D 3/60
(52) U.S. Cl. ..... 510/375; 510/376; 510/378
(58) Field of Search ..... 510/367, 422, 510/490, 375, 376, 378

(56) References Cited

U.S. PATENT DOCUMENTS 5,484,531 1/1996 Kuehne et al. ..... 210/653

FOREIGN PATENT DOCUMENTS 09-104900 4/1997 (JP) .

*Primary Examiner*—Yogendra Gupta
*Assistant Examiner*—John M Petruncio
(74) *Attorney, Agent, or Firm*—R. S. Echler, Sr.; K. W. Zerby; S. W. Miller

(57) ABSTRACT

Liquid compositions having a pH up to 7 comprise from 0.01% to 20% by weight of the total composition of a peroxygen bleach, from 0.001% to 30% by weight of the total composition of an ethoxylated nonionic surfactant, from 0.001% to 20% by weight of a zwitterionic betaine surfactant at a weight ratio of the ethoxylated nonionic surfactant to the zwitterionic betaine surfactant of from 0.01 to 20. These compositions are suitable to deliver improved stain removal performance and improved bleaching performance on various inanimate surfaces.

20 Claims, No Drawings

LIQUID AQUEOUS CLEANING COMPOSITIONS

TECHNICAL FIELD

The present invention relates to the cleaning of different surfaces such as hard-surfaces, fabrics, clothes and the like.

BACKGROUND

A wide variety of cleaning compositions have been extensively described in the art. Typically, cleaning compositions can be divided into hard surface cleaning compositions and laundry cleaning compositions. Cleaning compositions of these two types are traditionally very different in formulation and are sold as different products with different marketing concepts. These differences impose on the consumer to have to purchase and use at least two different products. Furthermore, compositions of the two types above, especially hard surface cleaners, can be divided into sub-types. Indeed, many different kinds of hard-surface cleaners are available, for instance bathroom cleaners, kitchen cleaners or floor cleaners.

This variety in formulation is rendered necessary by the difference in nature between the soils which can be found on laundry and on various hard-surfaces in kitchens and bathrooms. For instance, kitchen soils comprise mainly edible oils, while bathroom soils comprise mainly sebum and soap scum, also limescale; floor soils comprise mainly particulate soils and laundry may have many different soils/stains including greasy stains (e.g., olive oil, mayonnaise, vegetal oil make up), particulate stains and/or bleachable stains (e.g., tea, coffee).

However, there is a trend for the development of liquid aqueous cleaning compositions with better performance in several respect, i.e., liquid aqueous multi-purpose cleaners which can be satisfactorily used on various surfaces as well as in laundry applications, to clean various soils and stains. Such multi-purpose compositions are, for example, disclosed in European patent application, EP-A-598973. Indeed, this patent application discloses liquid aqueous compositions comprising hydrogen peroxide with a fully nonionic system, i.e., at least one nonionic with an HLB above 15, at least one nonionic with an HLB of from 13 to 15, at least one nonionic with an HLB of from 9 to 13 and at least one nonionic with an HLB below 9. This patent application further discloses the use of 2-alkyl alkanols as suds suppressors in said compositions.

But, it has been found that such liquid aqueous compositions comprising hydrogen peroxide, a 2-alkyl alkanol and as the surfactant system, a specific nonionic system of at least four nonionic surfactants having different HLB (hydrophilic lipophilic balance) as defined hereinbefore, do not satisfactorily meet consumer's needs. Indeed, such compositions based on a fully nonionic surfactant system and comprising a high level of hydrophobic surfactants were found to have poor performance on some kind of stains in laundry application. Although such hydrophobic nonionic surfactants have good grease cutting properties and are particularly effective on greasy soils having hydrophobic character, such as mineral oil and soap scum when used in hard surface cleaning composition, it has been found that when said hydrophobic nonionic surfactants are used in laundry applications bleachable stains are not satisfactorily bleached. The wettability of the fabrics stains is seriously affected by the hydrophobicity of the nonionic system of said compositions, i.e., good contact between hydrogen peroxide and the stains on said fabric is prevented resulting thereby in poor performance on bleachable stain. Also, it has been found that there is a problem associated with the use of such ingredients, i.e., hydrophobic nonionic surfactants and 2-alkyl alkanols, in that they may cause the final product to appear hazy, indicating insolubility and phase separation.

Other multi-purpose liquid cleaning compositions have been disclosed like thus described in EP-A-666 308. Indeed, EP-A-666 308 discloses compositions comprising hydrogen peroxide or a source thereof, a 2-alkyl alkanol, a hydrophobic surfactant having an HLB below 14 and an anionic surfactant. However, there is still room to further improve such multi-purpose liquid aqueous cleaning compositions in respect of overall cleaning performance on various types of stains including for example bleachable stains and greasy stains.

It is thus an object of the present invention to provide a multi-purpose liquid aqueous composition providing improved bleachable performance and improved stain removal performance especially on greasy stains, when used in laundry applications including laundry pretreatment applications, and/or in any household applications (e.g. cleaning of hard-surfaces typically found in kitchens or bathrooms).

It is a further object of the present invention to provide such an improved liquid aqueous cleaning composition which is also a clear composition in a broad range of temperature, e.g. up to 45° C.

It has now been found that these objects can be efficiently met by formulating a liquid aqueous cleaning composition having a pH up to 7 and comprising a peroxygen bleach, at least an ethoxylated nonionic surfactant and at least a zwitterionic betaine surfactant at a weight ratio of the ethoxylated nonionic surfactant to the zwitterionic betaine surfactant of from 0.01 to 20. Indeed, it is by combining these ingredients at the appropriate ratios that a multi-purpose liquid aqueous cleaning composition is provided which exhibits a great flexibility in the soils it may clean.

It has now been found that such a composition when used for example in a laundry application, especially in a pretreatment application, boosts the removal of various types of stains including greasy stains like lipstick, olive oil, mayonnaise, vegetal oil, sebum, make-up, and more surprisingly the bleaching performance, as compared to the stain removal and bleaching performance delivered by the same composition comprising only one of these surfactants (i.e., ethoxylated nonionic surfactant or zwitterionic betaine surfactant) at equal total level of surfactants. Also the compositions of the present invention significantly boost the removal of kitchen dirt when used to clean hard-surfaces, as compared to the same compositions comprising only one of these surfactants (i.e., ethoxylated nonionic surfactant or zwitterionic betaine surfactant) at equal total level of surfactants. Indeed, the compositions of the present invention provide excellent stain removal performance on a broad range of stains and soils and excellent bleachable performance when used in any laundry application, e.g., as a laundry detergent or a laundry additive, and especially when used as a laundry pretreater, or even in other household applications like in hard surface cleaning applications.

A further advantage is that the aqueous compositions herein are physically and chemically stable upon prolonged periods of storage.

Yet another advantage of the compositions according to the present invention is that they are able to perform in a variety of conditions, i.e., in hard and soft water as well as when used neat or diluted. Advantageously, they also provide satisfactory shine performance and surface safety when used as hard surface cleaners and satisfactory fabric and color safety when used as laundry cleaners.

SUMMARY OF THE INVENTION

The present invention encompasses a liquid aqueous composition having a pH up to 7 and comprising from 0.01% to 20% by weight of the total composition of a peroxygen bleach, from 0.001% to 30% by weight of the total composition of an ethoxylated nonionic surfactant, from 0.001% to 20% by weight of a zwitterionic betaine surfactant at a weight ratio of the ethoxylated nonionic surfactant to the zwitterionic betaine surfactant of from 0.01 to 20, with the proviso that said composition is free of an antimicrobial essential oil or an active thereof or a mixture thereof.

The present invention further encompasses processes of cleaning a surface, e.g. a fabric or a hard-surface, starting from a liquid aqueous composition as defined herein. For example, the processes of cleaning fabrics include the steps of contacting said fabrics with the liquid aqueous composition herein neat or diluted, and subsequently rinsing said fabrics. In the preferred embodiment, when the fabrics are "pretreated", the composition is applied neat on the fabrics, and the fabrics are subsequently washed in a normal wash cycle.

DETAILED DESCRIPTION OF THE INVENTION

The Liquid Aqueous Cleaning Composition

The compositions according to the present invention are liquid compositions as opposed to a solid or a gas. As used herein "liquid" includes "pasty" compositions. The liquid compositions herein are aqueous compositions. The liquid compositions according to the present invention have a pH up to 7, preferably from 1 to 6, and more preferably from 2 to 5. Formulating the compositions according to the present invention in the acidic pH range contribute to the chemical stability of the compositions and to the stain removal performance of the compositions. The pH of the compositions may be adjusted by any acidifying agents known to those skilled in the art. Examples of acidifying agents are organic acids such as citric acid and inorganic acids such as sulphuric acid.

As a first essential element the compositions according to the present invention comprise a peroxygen bleach or a mixture thereof. Indeed, the presence of peroxygen bleach contributes to the excellent bleaching benefits of said compositions. Suitable peroxygen bleaches to be used herein are hydrogen peroxide, water soluble sources thereof, or mixtures thereof. As used herein a hydrogen peroxide source refers to any compound which produces perhydroxyl ions when said compound is in contact with water.

Suitable water-soluble sources of hydrogen peroxide for use herein include percarbonates, persilicates, persulphates such as monopersulfate, perborates, peroxyacids such as diperoxydodecandioic acid (DPDA), magnesium perphtalic acid, perlauric acid, perbenzoic and alkylperbenzoic acids, hydroperoxides, aliphatic and aromatic diacyl peroxides, and mixtures thereof. Preferred peroxygen bleaches herein are hydrogen peroxide, hydroperoxide and/or diacyl peroxide. Hydrogen peroxide is the most preferred peroxygen bleach herein.

Suitable hydroperoxides for use herein are tert-butyl hydroperoxide, cumyl hydroperoxide, 2,4,4-trimethylpentyl-2-hydroperoxide, di-isopropylbenzenemonohydroperoxide, tert-amyl hydroperoxide and 2,5-dimethyl-hexane-2,5-dihydroperoxide. Such hydroperoxides have the advantage to be particularly safe to fabrics and color while delivering excellent bleaching performance when used in any laundry application.

Suitable aliphatic diacyl peroxides for use herein are dilauroyl peroxide, didecanoyl peroxide, dimyristoyl peroxide, or mixtures thereof. Suitable aromatic diacyl peroxide for use herein is for example benzoyl peroxide. Such diacyl peroxides have the advantage to be particularly safe to fabrics and color while delivering excellent bleaching performance when used in any laundry application.

The compositions herein comprise from 0.01% to 20% by weight of the total composition of said peroxygen bleach or mixtures thereof, preferably from 1% to 15% and more preferably from 2% to 10%.

As a second essential element the compositions according to the present invention comprise an ethoxylated nonionic surfactant or a mixture thereof at a level of from 0.001% to 30% by weight of the total composition. Preferably, the compositions herein comprise from 0.01% to 15% by weight of the total composition of said ethoxylated nonionic surfactant or mixture thereof, more preferably from 0.5% to 10%, even more preferably from 1% to 9% and most preferably from 1% to 6%.

Suitable ethoxylated nonionic surfactants herein are ethoxylated nonionic surfactants according to the formula $RO—(C_2H_4O)_nH$, wherein R is a $C_6$ to $C_{22}$ alkyl chain or a $C_6$ to $C_{28}$ alkyl benzene chain, and wherein n is from 0 to 20, preferably from 1 to 15 and, more preferably from 2 to 15 and most preferably from 2 to 12. The preferred R chains for use herein are the $C_8$ to $C_{22}$ alkyl chains.

Preferred ethoxylated nonionic surfactants are according to the formula above and have an HLB (hydrophilic-lipophilic balance) below 16, preferably below 15, and more preferably below 14. Those ethoxylated nonionic surfactants have been found to provide good grease cutting properties.

Accordingly suitable ethoxylated nonionic surfactants for use herein are Dobanol® 91-2.5 (HLB=8.1; R is a mixture of C9 and $C_{11}$ alkyl chains, n is 2.5), or Lutensol® TO3 (HLB=8; R is a $C_{13}$ alkyl chains, n is 3), or Lutensol® AO3 (HLB=8; R is a mixture of $C_{13}$ and $C_{15}$ alkyl chains, n is 3), or Tergitol® 25L3 (HLB=7.7; R is in the range of $C_{12}$ to $C_{15}$ alkyl chain length, n is 3), or Dobanol® 23-3 (HLB=8.1; R is a mixture of $C_{12}$ and $C_{13}$ alkyl chains, n is 3), or Dobanol® 23-2 (HLB=6.2; R is a mixture of $C_{12}$ and $C_{13}$ alkyl chains, n is 2), or Dobanol® 45-7 (HLB=11.6; R is a mixture of $C_{14}$ and $C_{15}$ alkyl chains, n is 7) Dobanol® 23-6.5 (HLB=11.9; R is a mixture of $C_{12}$ and $C_{13}$ alkyl chains, n is 6.5), or Dobanol® 25-7 (HLB=12; R is a mixture of $C_{12}$ and $C_{15}$ alkyl chains, n is 7), or Dobanol® 91-5 (HLB=11.6; R is a mixture of $C_9$ and $C_{11}$ alkyl chains, n is 5), or Dobanol® 91-6 (HLB=12.5; R is a mixture of $C_9$ and $C_{11}$ alkyl chains, n is 6), or Dobanol® 91-8 (HLB=13.7; R is a mixture of $C_9$ and $C_{11}$ alkyl chains, n is 8), Dobanol® 91-10 (HLB=14.2; R is a mixture of $C_9$ to $C_{11}$ alkyl chains, n is 10), or mixtures thereof. Preferred herein are Dobanol® 91-2.5 , or Lutensol® TO3, or Lutensol® AO3, or Tergitol® 25L3, or Dobanol® 23-3, or Dobanol® 23-2, or mixtures thereof. These Dobanol® surfactants are commercially available from SHELL. These Lutensol® surfactants are commercially available from BASF and these Tergitol® surfactants are commercially available from UNION CARBIDE.

Suitable chemical processes for preparing the ethoxylated nonionic surfactants for use herein include condensation of corresponding alcohols with alkylene oxide, in the desired proportions. Such processes are well-known to the man skilled in the art and have been extensively described in the art.

The compositions herein may desirably comprise one of those ethoxylated nonionic surfactants or a mixture of those ethoxylated nonionic surfactants having different HLBs (hydrophilic-lipophilic balance). In a preferred embodiment the compositions herein comprise an ethoxylated nonionic surfactant according to the above formula and having an HLB up to 10 (i.e., a so called hydrophobic ethoxylated nonionic surfactant), preferably below 10, more preferably below 9, and an ethoxylated nonionic surfactant according to the above formula and having an HLB above 10 to 16 (i.e., a so called hydrophilic ethoxylated nonionic surfactant), preferably from 11 to 14. Indeed, in this preferred embodiment the compositions of the present invention typically comprise from 0.01% to 15% by weight of the total composition of said hydrophobic ethoxylated nonionic surfactant, preferably from 0.5% to 10% and from 0.01% to 15% by weight of said hydrophilic ethoxylated nonionic surfactant, preferably from 0.5% to 10%. Such mixtures of ethoxylated nonionic surfactants with different HLBs may be desired as they allow optimum grease cleaning removal performance on a broader range of greasy soils having different hydrophobic/hydrophilic characters.

As a third essential element the compositions according to the present invention comprise a zwitterionic betaine surfactant or a mixture thereof at a level of from 0.001% to 20% by weight of the total composition. Preferably, the compositions herein comprise from 0.01% to 10% by weight of the total composition of said zwitterionic betaine surfactant or mixture thereof, more preferably from 0.5% to 8% and most preferably from 1% to 5%.

Suitable zwitterionic betaine surfactants to be used herein contain both a cationic hydrophilic group, i.e., a quaternary ammonium group, and anionic hydrophilic group on the same molecule at a relatively wide range of pH's. The typical anionic hydrophilic groups are carboxylates and sulfonates, although other groups like sulfates, phosphonates, and the like can be used. A generic formula for the zwitterionic betaine surfactants to be used herein is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a$—C(O)—NH—$(C(R_b)_2)_m$, wherein $R_a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is a $C_1$–$C_4$ carboxylic acid group or C1–C4 sulfonate group, or a $C_1$–$C_3$ alkyl and more preferably methyl. Preferred $R_4$ is $(CH2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or C10–C14 fatty acylamidopropylene(hydropropylene) sulfobetaine. For example C10–C14 fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Mirataine H2C-HA®.

Particularly preferred zwitterionic betaine surfactants for use herein are salt free, i.e. that the zwitterionic betaine surfactant raw material contains less than 5% by weight of salts, preferably less than 2%, more preferably less than 1% and most preferably from 0.01% to 0.5%.

By "salts" is in meant herein any material having as base unit, a couple of positive ion (or positive molecular ion) and negative ion (or negative molecular ion) containing one or more halogen atoms. Such salts include sodium chloride, potassium chloride, sodium bromide and the like.

Such salts free zwitterionic betaine surfactants are obtainable by conventional manufacturing processes like inverse osmosis or fractionated precipitation. For example inverse osmosis is based on the principle of contacting the zwitterionic betaine surfactant raw material (commercially available ) with a polar solvent (it is to be understood that such a solvent is free of salts) separated by a semi-permeable membrane for example acetate-cellulose. An adequate pressure is applied on the system to allow the salts to migrate from the surfactant raw material to the polar solvent phase. This way the zwitterionic betaine surfactant raw material is purified, i.e. the salts is subtracted from the raw material.

Advantageously, it has now been surprisingly found that the use of such salt free zwitterionic betaine surfactants delivers improved fabric safety and/or color safety when bleaching fabrics with a peroxygen bleach-containing composition comprising the same, as compared to the use of the same zwitterionic betaine surfactant raw materials with higher amount of salts. Thus, in its broadest aspect, the present invention also encompasses the use of a composition comprising a salt free zwitterionic betaine surfactant and a peroxygen bleach for bleaching fabrics whereby color safety is improved (i.e. color damage/decoloration is reduced) and/or fabric safety is improved.

The betaine zwitterionic surfactants herein have the ability to further boost the stain removal performance delivered by the ethoxylated nonionic surfactants herein on greasy stains, while providing improved bleaching performance to the liquid peroxygen bleach-containing compositions of the present invention comprising them.

Indeed, a significant cooperation has been observed between these ingredients to get optimum stain removal performance on a variety of soils, from particulate to non-particulate soils from hydrophobic to hydrophilic soils under any household application and especially laundry application on both hydrophilic and hydrophobic fabrics.

Optimum stain removal performance and bleaching performance are obtained when the ethoxylated nonionic surfactant and the zwitterionic betaine surfactant are present in the compositions of the present invention comprising a peroxygen bleach (pH up to 7), at weight ratio of the ethoxylated nonionic surfactant to the zwitterionic betaine surfactant of from 0.01 to 20, preferably from 0.1 to 15, more preferably from 0.5 to 5 and most preferably from 0.8 to 3.

Advantageously excellent stain removal performance and bleaching performance can be obtained with the compositions herein at low total level of surfactants. Typically, the compositions herein comprise from 0.01% to 35% by weight of the total composition of ethoxylated nonionic surfactant and zwitterionic betaine surfactant, preferably from 0.1% to 15%, more preferably from 0.5% to 10%, even more preferably below 10% and most preferably from 1% to 8%.

Indeed, the present invention is based on the finding that the use of zwitterionic betaine surfactant on top of the ethoxylated nonionic surfactant at the appropriate ratios, in a liquid aqueous composition comprising a peroxygen bleach (pH up to 7), boosts the bleaching performance and the removal of various types of stains including greasy stains (e.g., lipstick, olive oil, mayonnaise, vegetal oil, sebum, make-up), as compared to the bleaching and stain removal performance delivered by the same composition based only on one of these surfactants (i.e., ethoxylated nonionic surfactant or zwitterionic betaine surfactant) at equal total level of surfactants. For example, it is only at very high levels of nonionic surfactants as compared the total level of ethoxylated nonionic surfactants and zwitterionic betaine surfactants present in the compositions of the present invention that similar grease cleaning benefit is observed. Importantly, the improved stain removal benefit and bleaching benefit are delivered with a liquid aqueous composition which is a water-like, clear and transparent composition.

The appearance of a composition can be evaluated via turbidimetric analysis. For example, the transparency of a composition can be evaluated by measuring its absorbency via a spectrophotometer at 800 nm wave length.

The stain removal performance may be evaluated by the following test methods on various type of stains.

A suitable test method for evaluating the stain removal performance on a soiled fabric for example under pretreatment condition is the following: A composition according to the present invention is applied neat to a fabric preferably to the soiled portion of the fabric, left to act from 1 to 10 minutes, and said pretreated fabric is then washed according to common washing conditions, at a temperature of from 30° to 70° C. for from 10 to 100 minutes. The stain removal is then evaluated by comparing side by side the soiled fabric pretreated with the composition of the present invention with those pretreated with the reference, e.g., the same composition but comprising only an alkoxylated nonionic surfactant or only a zwitterionic betaine surfactant as the sole surfactant. A visual grading may be used to assign difference in panel units (psu) in a range from 0 to 4.

A suitable test method for evaluating cleaning performance on a hard-surface is the following: synthetic soil representative of typical hard surface household kitchen dirt soil can be used. The test-soil is applied on an enamel-coated metal plate (cleaned with a detergent and then with alcohol) with a paint roller, and the plates are baked at 130° C. for 30 minutes. After 24 hours they can be used for the test. This test is evaluated in a Gardner straight-line scrub machine. The results are given in number of strokes a given composition needs to clean a standard soiled plate. The lower the number of strokes needed the more efficient in terms of satin removal is the composition used to clean the dirt from the test plates.

The bleaching performance may be evaluated as for the stain removal performance but the stains used are bleachable stains like coffee, tea and the like.

An advantage of the liquid aqueous compositions of the present invention is that they are physically and chemically stable upon prolonged periods of storage.

Chemical stability of the compositions herein may be evaluated by measuring the concentration of available oxygen (often abbreviated to AvO2) at given storage time after having manufactured the compositions. The concentration of available oxygen can be measured by chemical titration methods known in the art, such as the iodometric method, thiosulphatimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970.

By "physically stable" it is meant herein that no phase separation occurs in the compositions for a period of 7 days at 50° C.

Optional Ingredients

The compositions herein may further comprise a variety of other optional ingredients such as chelating agents, builders, other surfactants, stabilisers, bleach activators, soil suspenders, soil suspending polyamine polymers, polymeric soil release agents, radical scavengers, catalysts, dye transfer agents, solvents, brighteners, perfumes, pigments and dyes.

In a preferred embodiment of the present invention the ionic strength of the compositions is higher than $1.10^{-4}$ M, preferably higher than $5.10^{-3}$ M, and more preferably higher than $1.10^{-3}$ M. Indeed, it has been observed that formulating the compositions of the present invention with such high ionic strength further contributes to their benefits, i.e., improved stain removal performance and improved bleaching performance. The higher the ionic strength the better the stain removal and bleaching performance. Indeed, it is speculated that under the pH conditions of the present compositions (acidic to neutral), especially when the pH of the composition is higher than the pka of the zwitterionic betaine surfactant present therein, said surfactant is in a dipolar form and its packing is strongly influenced by the ionic strength.

The ionic strength of a composition may be increased by the addition of various ingredients like chelating agents or mixtures thereof.

Accordingly, the compositions of the present invention may comprise a chelating agent as a preferred optional ingredient. Suitable chelating agents may be any of those known to those skilled in the art such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof.

A chelating agent may be desired in the compositions of the present invention as it allows to increase the ionic strength of the compositions herein and thus their stain removal and bleaching performance on various surfaces. The presence of chelating agents may also contribute to reduce tensile strength loss of fabrics and/or color damage, especially in a laundry pretreatment application. Indeed, the chelating agents inactivate the metal ions present on the surface of the fabrics and/or in the cleaning compositions (neat or diluted) that otherwise would contribute to the radical decomposition of the peroxygen bleach.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Another chelating agent for use herein is of the formula:

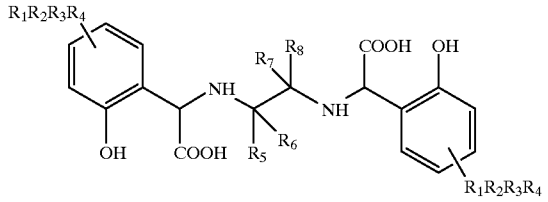

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N, N'-disuccinic acid, and mixtures thereof.

Typically, the compositions according to the present invention comprise up to 5% by weight of the total composition of a chelating agent, or mixtures thereof, preferably from 0.01% to 1.5% by weight and more preferably from 0.01% to 0.5%.

The compositions of the present invention may further comprise other surfactants than the ones mentioned hereinbefore including other nonionic surfactants, anionic surfactants, cationic surfactants and/or amphoteric surfactants.

Typically, the compositions according to the present invention may comprise from 0.01% to 30% by weight of the total composition of another surfactant on top of the zwitterionic betaine surfactant and ethoxylated nonionic surfactant, preferably from 0.1% to 25% and more preferably from 0.5% to 20%.

Suitable nonionic surfactants to be used herein include polyhydroxy fatty acid amide surfactants, or mixtures thereof, according to the formula $$R^2—C(O)—N(R^1)—Z,$$

wherein $R^1$ is H, or $C_1$–$C_4$ alkyl, $C_1$–$C_4$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$–$C_4$ alkyl, more preferably $C_1$ or $C_2$ alkyl and most preferably methyl, $R^2$ is a straight chain $C_7$–$C_{19}$ alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilised as well as the individual sugars listed above. These corn syrups may yield a mix of sugar components for Z. It should be understood that it is by no means intended to exclude other suitable raw materials.

Z preferably will be selected from the group consisting of $—CH_2—(CHOH)_n—CH_2OH$, $—CH(CH_2OH)—(CHOH)_{n-1}—CH_2OH$, $—CH_2—(CHOH)_2—(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2—(CHOH)_4—CH_2OH$.

In formula $R^2—C(O)—N(R^1)—Z$, $R^1$ can be, for example, N-methyl, N-ethyl, N-propyl, N-isopropyl, N-butyl, N-2-hydroxy ethyl, or N-2-hydroxy propyl. $R^2—C(O)–N<$ can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants to be used herein may be commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

Suitable anionic surfactants to be used in the compositions herein include water-soluble salts or acids of the formula $ROSO_3M$ wherein R preferably is a $C_{10}–C_{24}$ hydrocarbyl, preferably an alkyl or hydroxyalkyl having a $C_{10}–C_{20}$ alkyl component, more preferably a $C_{12}–C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Other suitable anionic surfactants for use herein are water-soluble salts or acids of the formula $RO(A)_mSO_3M$ wherein R is an unsubstituted $C_{10}–C_{24}$ alkyl or hydroxyalkyl group having a $C_{10}–C_{24}$ alkyl component, preferably a $C_{12}–C_{20}$ alkyl or hydroxyalkyl, more preferably $C_{12}–C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}–C_{18}$ alkyl polyethoxylate (1.0) sulfate, $C_{12}–C_{18}E(1.0)M$), $C_{12}–C_{18}$ alkyl polyethoxylate (2.25) sulfate, $C_{12}–C_{18}E(2.25)M$), $C_{12}–C_{18}$ alkyl polyethoxylate (3.0) sulfate $C_{12}–C_{18}E(3.0)$, and $C_{12}–C_{18}$ alkyl polyethoxylate (4.0) sulfate $C_{12}–C_{18}E(4.0)M$), wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9–C_{20}$ linear alkylbenzenesulfonates, $C_8–C_{22}$ primary or secondary alkanesulfonates, $C_8–C_{24}$ olefinsulfonates, sulfonated polycarboxylic acids prepared by sulfonation of the pyrolyzed product of alkaline earth metal citrates, e.g., as described in British patent specification No. 1,082,179, $C_8–C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}–C_{18}$ monoesters) diesters of sulfosuccinate (especially saturated and unsaturated $C_6–C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8–C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants to be used herein also include acyl sarcosinate or mixtures thereof, in its acid and/or salt form, preferably long chain acyl sarcosinates having the following formula:

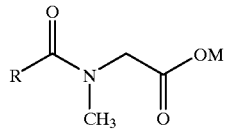

wherein M is hydrogen or a cationic moiety and wherein R is an alkyl group of from 11 to 15 carbon a toms, preferably of from 11 to 13 carbon atoms. Preferred M are hydrogen and alkali metal salts, especially sodium and potassium. Said acyl sarcosinate surfactants are derived from natural fatty acids and the aminoacid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Suitable amphoteric surfactants to be used herein include amine oxides having the following formula $R_1R_2R_3NO$ wherein each of R1, R2 and R3 is independently a saturated substituted or unsubstituted, linear or branched hydrocarbon chains of from 1 to 30 carbon atoms. Preferred amine oxide surfactants to be used according to the present invention are amine oxides having the following formula $R_1R_2R_3NO$ wherein R1 is an hydrocarbon chain comprising from 1 to 30 carbon atoms, preferably from 6 to 20, more preferably from 8 to 16, most preferably from 8 to 12, and wherein R2 and R3 are independently substituted or unsubstituted, linear or branched hydrocarbon chains comprising from 1 to 4 carbon atoms, preferably from 1 to 3 carbon atoms, and more preferably are methyl groups. R1 may be a saturated substituted or unsubstituted linear or branched hydrocarbon chain. Suitable amine oxides for use herein are for instance natural blend C8–C10 amine oxides as well as C12–C16 amine oxides commercially available from Hoechst.

The compositions of the present invention may comprise a radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®. Radical scavengers when used, are typically present herein in amounts ranging from up to 10% by weight of the total composition and preferably from 0.001% to 0.5% by weight.

The presence of radical scavengers may contribute to reduce tensile strength loss of fabrics and/or color damage when the compositions of the present invention are used in any laundry application, especially in a laundry pretreatment application.

The compositions according to the present invention may further comprise an antioxidant or mixtures thereof. Typically, the compositions herein comprise up to 10% by weight of the total composition of an antioxidant or mixtures thereof, preferably from 0.002% to 5%, more preferably from 0.005% to 2%, and most preferably from 0.01% to 1%.

Suitable antioxidants to be used herein include organic acids like citric acid, ascorbic acid, tartaric acid, adipic acid and sorbic acid, or amines like lecithin, or aminoacids like glutamine, methionine and cysteine, or esters like ascorbil palmitate, ascorbil stearate and triethylcitrate, or mixtures thereof. Preferred antioxidants for use herein are citric acid, ascorbic acid, ascorbil palmitate, lecithin or mixtures thereof.

As an optional ingredient, the compositions of the present invention may comprise a bleach activator or mixtures thereof. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition. The compositions according to the present invention may comprise from 0.01% to 20% by weight of the total composition of said bleach activator, or mixtures thereof, preferably from 1% to 10%, and more preferably from 3% to 7%

Cleaning Processes

In the present invention, the liquid aqueous cleaning composition of the present invention needs to be contacted with the surface to clean.

By "surfaces" it is meant herein any inanimate surface. These inanimate surfaces include, but are not limited to, hard-surfaces typically found in houses like kitchens, bathrooms, or in car interiors, e.g., tiles, walls, floors, chrome, glass, smooth vinyl, any plastic, plastified wood, table top, sinks, cooker tops, dishes, sanitary fittings such as sinks, showers, shower curtains, wash basins, WCs and the like, as well as fabrics including clothes, curtains, drapes, bed linens, bath linens, table cloths, sleeping bags, tents, upholstered furniture and the like, and carpets. Inanimate surfaces also include household appliances including, but not limited to, refrigerators, freezers, washing machines, automatic dryers, ovens, microwave ovens, dishwashers and so on.

Thus, the present invention also encompasses a process of cleaning a fabric, as the inanimate surface. In such a process a composition, as defined herein, is contacted with the fabrics to be cleaned. This can be done either in a so-called "pretreatment mode", where a composition, as defined herein, is applied neat onto said fabrics before the fabrics are rinsed, or washed then rinsed, or in a "soaking mode" where a composition, as defined herein, is first diluted in an aqueous bath and the fabrics are immersed and soaked in the bath, before they are rinsed, or in a "through the wash mode", where a composition, as defined herein, is added on top of a wash liquor formed by dissolution or dispersion of a typical laundry detergent. It is also essential in both cases, that the fabrics be rinsed after they have been contacted with said composition, before said composition has completely dried off.

Indeed, it has been found that water evaporation contributes to increase the concentration of free radicals onto the surface of the fabrics and, consequently, the rate of chain reaction. It is also speculated that an auto-oxidation reaction occurs upon evaporation of water when the liquid compositions are left to dry onto the fabrics. Said reaction of auto-oxidation generates peroxy-radicals which may contribute to the degradation of cellulose. Thus, not leaving the liquid compositions, as described herein, to dry onto the fabric, in a process of pretreating soiled fabrics, contributes to reduce the tensile strength loss and/or color damage when pretreating fabrics with liquid peroxygen bleach-containing compositions.

In the pretreatment mode, the process comprises the steps of applying said liquid composition in its neat form onto said fabrics, or at least soiled portions thereof, and subsequently rinsing, or washing then rinsing said fabrics. In this mode, the neat compositions can optionally be left to act onto said fabrics for a period of time ranging from 1 min. to 1 hour, before the fabrics are rinsed, or washed then rinsed, provided that the composition is not left to dry onto said fabrics. For particularly though stains, it may be appropriate to further rub or brush said fabrics by means of a sponge or a brush, or by rubbing two pieces of fabrics against each other.

In another mode, generally referred to as "soaking", the process comprises the steps of diluting said liquid composition in its neat form in an aqueous bath so as to form a diluted composition. The dilution level of the liquid composition in an aqueous bath is typically up to 1:85, preferably up to 1:50 and more preferably about 1:25 (composition:water). The fabrics are then contacted with the aqueous bath comprising the liquid composition, and the fabrics are finally rinsed, or washed then rinsed. Preferably in that embodiment, the fabrics are immersed in the aqueous bath comprising the liquid composition, and also preferably, the fabrics are left to soak therein for a period of time ranging from 1 minute to 48 hours, preferably from 1 hour to 24 hours.

In yet another mode which can be considered as a sub-embodiment of "soaking", generally referred to as "bleaching through the wash", the liquid composition is used as a so-called laundry additive. And in that embodiment the aqueous bath is formed by dissolving or dispersing a conventional laundry detergent in water. The liquid composition in its neat form is contacted with the aqueous bath, and the fabrics are then contacted with the aqueous bath containing the liquid composition. Finally, the fabrics are rinsed.

In another embodiment the present invention also encompasses a process of cleaning a hard-surface, as the inanimate surface. In such a process a composition, as defined herein, is contacted with the hard-surfaces to be cleaned. Thus, the present invention also encompasses a process of cleaning a hard-surface with a composition, as defined herein, wherein said process comprises the step of applying said composition to said hard-surface, preferably only soiled portions thereof, and optionally rinsing said hard-surface.

In the process of cleaning hard-surfaces according to the present invention the composition, as defined herein, may be applied to the surface to be cleaned in its neat form or in its diluted form typically up to 200 times their weight of water, preferably into 80 to 2 times their weight of water, and more preferably 60 to 2 times.

When used as hard surfaces cleaners the compositions of the present invention are easy to rinse and provide good shine characteristics on the cleaned surfaces.

Depending on the end-use envisioned, the compositions herein can be packaged in a variety of containers including conventional bottles, bottles equipped with roll-on, sponge, brusher or sprayers.

The invention is further illustrated by the following examples.

EXAMPLES

Following compositions were made by mixing the listed ingredients in the listed proportions (weight % unless otherwise specified).

| Compositions | I | II | III | IV | V | VI | VII | VIII |
|---|---|---|---|---|---|---|---|---|
| Dobanol ® 91-10 | — | — | — | 1.6 | 0.8 | — | 1.6 | — |
| Dobanol ® 45-7 | 1.6 | 2.0 | 1.6 | — | 0.8 | 1.6 | — | 2.0 |
| Dobanol ® 23-3 | 2.0 | — | 2.0 | 2.0 | 2.0 | 2.0 | 2.0 | — |
| Lauryl Betaine | — | — | 2.4 | 2.4 | 2.4 | 5.0 | 5.0 | 5.0 |
| Mirataine H2C-HA ® | 5.0 | 2.4 | — | — | — | — | — | — |
| $H_2O_2$ | 7.0 | 7.0 | 7.0 | 7.0 | 7.0 | 7.0 | 7.0 | 7.0 |
| HEDP | 0.16 | — | 0.16 | 0.16 | — | 0.16 | 0.16 | 0.16 |
| DTPMP | — | 0.18 | — | — | 0.18 | — | — | — |
| Propyl gallate | 0.1 | 0.1 | 0.1 | 0.1 | 0.3 | 0.1 | 0.1 | 0.1 |
| Citric acid | 0.05 | 0.05 | 0.05 | 0.05 | 0.05 | 0.05 | 0.05 | 0.05 |
| Water and minors | | | | up to 100% | | | | |
| H2SO4 up to pH 4 | | | | | | | | |

HEDP is 1-hydroxy-ethane diphosphonate.
DTPMP is diethylene triamine penta methylene phosphonate.
Mirataine H2C-HA ® is Lauryl-immino-dipropionate

| Compositions | IX | X | XI | XII | XIII | XIV | XV | XVI |
|---|---|---|---|---|---|---|---|---|
| Dobanol ® 91-10 | — | — | — | 1.6 | — | — | 1.6 | — |
| Dobanol ® 45-7 | — | 2.0 | 1.6 | — | 2.6 | 1.6 | — | 2.0 |
| Dobanol ® 23-3 | — | — | 2.0 | 2.0 | 1.0 | 2.0 | 2.0 | — |
| Salt-free Betaine* | 5.0 | 2.4 | 2.4 | 2.4 | 2.4 | 5.0 | 5.0 | 5.0 |
| $H_2O_2$ | 7.0 | 7.0 | 6.0 | 7.0 | 5.8 | 7.0 | 7.0 | 7.0 |
| HEDP | 0.16 | — | 0.16 | — | 0.16 | 0.16 | 0.16 | 0.16 |
| DTPMP | — | 0.18 | — | 0.18 | — | — | — | — |
| Propyl gallate | 0.1 | 0.1 | — | — | — | 0.1 | 0.1 | 0.1 |
| BHT | — | — | 0.1 | 0.1 | 0.1 | — | — | — |
| Citric acid | 0.05 | 0.05 | 0.50 | 0.05 | 0.50 | 0.05 | 0.05 | 0.05 |
| Water and minors | | | | up to 100% | | | | |
| H2SO4 up to pH 4 or 5 | | | | | | | | |

Salt-free Betaine* is Lauryl di-methyl betaine containing 0.3% by weight of sodium chloride. This betaine is obtained by purification from commercially available Lauryl di-methyl betaine GENAGEN LAB® (Hoechst) (which contains 7.5% by weight of sodium chloride).

Compositions I to XVI when used to clean soiled colored fabrics exhibit excellent overall stain removal performance especially on greasy stains like lipstick, make-up, olive oil, mayonnaise, sebum and the like, and improved bleaching performance.

When used in a pretreatment mode, any of the compositions I to XVI is applied neat on the stained portion of a fabric and left to act thereon for 5 minutes. Then the fabric is washed with a conventional detergent and rinsed. When used in a bleaching-through-the-wash mode, any of the compositions I to XVI is contacted with an aqueous bath formed by dissolution of a conventional detergent in water. Fabrics are then contacted with the aqueous bath comprising the liquid detergent, and the fabrics are rinsed. They can also be used in a soaking mode, where 100 ml of the liquid compositions are diluted in 10 liters of water. The fabrics are then contacted with this aqueous bath containing the composition, and left to soak therein for a period of time of 24 hours. The fabrics are eventually rinsed.

Compositions I to XVI when used to clean soiled hard-surfaces exhibit excellent overall stain removal performance especially on kitchen dirt greasy stains.

Compositions IX to XVI when used to clean soiled colour fabrics in any laundry application and especially in pretreatment conditions are safe to both the fabrics and colours.

What is claimed is:

1. A cleaning composition comprising:

a) from 0.01% to 20% by weight, of a peroxygen bleach;

b) from 0.001% to 30% by weight, of an ethoxylated nonionic surfactant having the formula:

$$RO(CH_2CH_2O)_nH$$

wherein R is $C_6$–$C_{22}$ alkyl, $C_6$–$C_{28}$ alkylbenzene, and mixtures thereof, n is from 1 to 15;

c) from 0.001% to 20% by weight, of a zwitterionic betaine surfactant having the formula:

$$R_1N^+(R_2)(R_3)R_4X^-$$

wherein $R_1$ is $C_1$–$C_{24}$ alkyl; $R_2$ is hydrogen, $C_1$–$C_6$ alkyl, $C_1$–$C_6$ hydroxyalkyl, $C_1$–$C_6$ substituted alkyl, an amido unit having the formula:

$$R_a—C(O)—NH—(C(R_b)_2)_m$$

wherein $R_a$ is a saturated or unsaturated aliphatic unit which is substituted or unsubstituted, an aromatic unit which is substituted or unsubstituted, $R_b$ is hydrogen, hydroxy, and mixtures thereof, m is from 1 to 4; $R_3$ is hydrogen, $C_1$–$C_6$ alkyl, $C_1$–$C_6$ hydroxyalkyl, $C_1$–$C_6$ substituted alkyl, a sulfonate comprising $C_1$–$C_6$ alkyl unit, a carboxylate comprising $C_1$–$C_6$ alkyl unit, and mixtures thereof; $R_2$ and $R_3$ can be taken together with the nitrogen atom to form a $C_2$–$C_{12}$ heterocyclic ring; $R_4$ is $C_1$–$C_{10}$ alkylene, $C_1$–$C_{10}$ hydroxyalkylene, $C_1$–$C_{10}$ polyalkyleneoxy, and mixtures thereof; X is a carboxylate or sulfonate unit; and d) the balance carriers and adjunct ingredients;

wherein the ratio of nonionic surfactant to betaine surfactant is from 0.01 to 20, said composition having a pH up to 7.

2. A composition according to claim 1 wherein said bleach is selected from the group consisting of hydrogen peroxide, percarbonates, persilicates, persulphates, perborates, peroxyacids, hydroperoxides, aromatic diacyl peroxides, aromatic diacyl peroxides, and mixtures thereof.

3. A composition according to claim 2 wherein said bleach is selected from the group consisting of tert-butyl hydroperoxide, cumyl hydroperoxide, 2,4,4-trimethylpentyl-2-hydroperoxide, di-isopropylbenzene monohydroperoxide, tert-amyl hydroperoxide, 2,5-dimethylhexane-2,5-dihydroperoxide, dilauroyl peroxide, didecanoyl peroxide, dimyristoyl peroxide, benzoyl peroxide, and mixtures thereof.

4. A composition according to claim 1 comprising from 1% to 15% by weight, of said peroxygen bleach.

5. A composition according to claim 4 comprising from 2% to 10% by weight, of said peroxygen bleach.

6. A composition according to claim 1 wherein said composition comprises from 0.01% to 15% by weight, of said nonionic surfactant.

7. A composition according to claim 6 wherein said composition comprises from 0.5% to 10% by weight, of said nonionic surfactant.

8. A composition according to claim 7 wherein said composition comprises from 1% to 6% by weight, of said nonionic surfactant.

9. A composition according to claim 1 wherein said composition comprises from 0.01% to 10% by weight, of said betaine surfactant.

10. A composition according to claim 9 wherein said composition comprises from 0.5% to 8% by weight, of said betaine surfactant.

11. A composition according to claim 10 wherein said composition comprises from 1% to 5% by weight, of said betaine surfactant.

12. A composition according to claim 1 further comprising from 0.01% to 5% by weight, of a chelating agent.

13. A composition according to claim 1 wherein said adjunct ingredients are selected from the group consisting of builders, anionic surfactants, cationic surfactants, stabilizers, bleach activators, soil suspenders, soil suspending polyamine polymers, polymeric soil release a gents, radical scavengers, catalysts, dye transfer inhibitors, solvents, brighteners, perfumes, dyes, pigments, and mixtures thereof.

14. A cleaning composition comprising:

a) from 0.01% to 20% by weight, of a peroxygen bleach selected from the group consisting of perborate, percarbonate, persulphate, persilicate, and mixtures thereof;

b) from 0.01% to 20% by weight, of a bleach activator;

c) from 0.001% to 30% by weight, of an ethoxylated nonionic surfactant having the formula:

$$RO(CH_2CH_2O)_nH$$

wherein R is $C_6$–$C_{22}$ alkyl, $C_6$–$C_{28}$ alkylbenzene, and mixtures thereof, n is from 0 to 20;

d) from 0.001% to 20% by weight, of a zwitterionic betaine surfactant having the formula:

$$R_1N^+(R_2)(R_3)R_4X^-$$

wherein $R_1$ is $C_1$–$C_{24}$ alkyl; $R_2$ is hydrogen, $C_1$–$C_6$ alkyl, $C_1$–$C_6$ hydroxyalkyl, $C_1$–$C_6$ substituted alkyl, an amido unit having the formula:

$$R_a—C(O)—NH—(C(R_b)_2)_m$$

wherein $R_a$ is a saturated or unsaturated aliphatic unit which is substituted or unsubstituted, an aromatic unit which is substituted or unsubstituted, $R_b$ is hydrogen, hydroxy, and mixtures thereof, m is from 1 to 4; $R_3$ is hydrogen, $C_1$–$C_6$ alkyl, $C_1$–$C_6$ hydroxyalkyl, $C_1$–$C_6$ substituted alkyl, a sulfonate comprising $C_1$–$C_6$ alkyl unit, a carboxylate comprising $C_1$–$C_6$ alkyl unit, and mixtures thereof; $R_2$ and $R_3$ can be taken together with the nitrogen atom to form a $C_2$–$C_{12}$ heterocyclic ring; $R_4$ is $C_1$–$C_{10}$ alkylene, $C_1$–$C_{10}$ hydroxyalkylene, $C_1$–$C_{10}$ polyalkyleneoxy, and mixtures thereof; X is a carboxylate or sulfonate unit; and e) the balance carriers and adjunct ingredients;

wherein said composition has a pH of less than or equal to 7.

15. A composition according to claim 14 wherein the ratio of nonionic surfactant to betaine surfactant is from 0.01 to 20.

16. A composition according to claim 15 wherein said bleach activator is selected from the group consisting of nonanoyloxybenzeneslphonate, nonylamide of peroxyadipic acid, benzoyl caprolactam, octanoyl caprolactam, nonanoyl caprolactam, tetraacetyl ethylenediamine, diperoxy dodecanoic acid, and mixtures thereof.

17. A composition according to claim 14 wherein said adjunct ingredients are selected from the group consisting of builders, anionic surfactants, cationic surfactants, stabilizers, bleach activators, soil suspenders, soil suspending polyamine polymers, polymeric soil release a gents, radical scavengers, catalysts, dye transfer inhibitors, solvents, brighteners, perfumes, dyes, pigments, and mixtures thereof.

18. A cleaning composition comprising:

a) from 0.01% to 20% by weight, of a peroxygen bleach;

b) from 0.001% to 30% by weight, of an ethoxylated nonionic surfactant having the formula:

$$RO(CH_2CH_2O)_nH$$

wherein R is $C_6$–$C_{22}$ alkyl, $C_6$–$C_{28}$ alkylbenzene, and mixtures thereof, n is from 0 to 20;

c) from 0.001% to 20% by weight, of a zwitterionic betaine surfactant having the formula:

$$R_1N^+(R_2)(R_3)R_4X^-$$

wherein $R_1$ is $C_1$–$C_{24}$ alkyl; $R_2$ is hydrogen, $C_1$–$C_6$ alkyl, $C_1$–$C_6$ hydroxyalkyl, $C_1$–$C_6$ substituted alkyl, an amido unit having the formula:

$$R_a—C(O)—NH—(C(R_b)_2)_m$$

wherein $R_a$ is a saturated or unsaturated aliphatic unit which is substituted or unsubstituted, an aromatic unit which is substituted or unsubstituted, $R_b$ is hydrogen, hydroxy, and mixtures thereof, m is from 1 to 4; $R_3$ is hydrogen, $C_1$–$C_6$ alkyl, $C_1$–$C_6$ hydroxyalkyl, $C_1$–$C_6$ substituted alkyl, a sulfonate comprising $C_1$–$C_6$ alkyl unit, a carboxylate comprising $C_1$–$C_6$ alkyl unit, and mixtures thereof; $R_2$ and $R_3$ can be taken together with the nitrogen atom to form a $C_2$–$C_{12}$ heterocyclic ring; $R_4$ is $C_1$–$C_{10}$ alkylene, $C_1$–$C_{10}$ hydroxyalkylene, $C_1$–$C_{10}$ polyalkyleneoxy, and mixtures thereof; X is a carboxylate or sulfonate unit; and d) the balance carriers and adjunct ingredients, wherein said adjunct ingredients are selected from the group consisting of builders, anionic surfactants, cationic surfactants, stabilizers, bleach activators, soil suspenders, soil suspending polyamine polymers, polymeric soil release a gents, radical scavengers, catalysts, dye transfer inhibitors, solvents, brighteners, perfumes, dyes, pigments, and mixtures thereof;

wherein the ratio of nonionic surfactant to betaine surfactant is from 0.01 to 20 and the pH is less than or equal to 7.

19. A composition according to claim 18 further comprising from 0.01% to 20% by weight, of a bleach activator, said bleach activator is selected from the group consisting of nonanoyloxybenzeneslphonate, nonylamide of peroxyadipic acid, benzoyl caprolactam, octanoyl caprolactam, nonanoyl caprolactam, tetraacetyl ethylenediamine, diperoxy dodecanoic acid, and mixtures thereof.

20. A composition according to claim 18 wherein said bleach is selected from the group consisting of hydrogen peroxide, percarbonates, persilicates, persulphates, perborates, peroxyacids, hydroperoxides, aromatic diacyl peroxides, aromatic diacyl peroxides, and mixtures thereof.

* * * * *

UNITED STATES PATENT AND TRADEMARK OFFICE

CERTIFICATE OF CORRECTION

PATENT NO. : 6,235,699 B1
DATED : May 22, 2001
INVENTOR(S) : Valerio Del Duca et al.

It is certified that error appears in the above-identified patent and that said Letters Patent is hereby corrected as shown below:

Column 18,
Line 28, "a gents" should read -- agents --.

Column 19,
Line 8, "nonanoyloxybenzeneslphonate" should read nonanoyloxybenzenesulphonate --.
Line 16, "a gents" should read -- agents --.

Column 20,
Line 18, "a gents" should read -- agents --.

Signed and Sealed this

Twenty-fifth Day of December, 2001

*Attest:*

*Attesting Officer*

JAMES E. ROGAN
*Director of the United States Patent and Trademark Office*